US005481994A

United States Patent [19]

Ku

[11] Patent Number: 5,481,994

[45] Date of Patent: Jan. 9, 1996

[54] THREAD CUTTER FOR A CHAINSTICH SEWING MACHINE

[76] Inventor: Fei-Lung Ku, No. 10, Alley 6, Lane 148, Kai Yuan Road, Tainan, Taiwan

[21] Appl. No.: 418,188

[22] Filed: Apr. 7, 1995

[51] Int. Cl.[6] ..... D05B 65/00

[52] U.S. Cl. ..... 112/298; 112/199

[58] Field of Search ..... 112/288, 296, 112/298, 285, 291, 199, 292

[56] References Cited

U.S. PATENT DOCUMENTS

| | | | |
|---|---|---|---|
| 4,726,305 | 2/1988 | Seto | 112/298 |
| 5,337,688 | 8/1994 | Arima | 112/298 |
| 5,415,119 | 5/1995 | Ikeda | 112/296 |

*Primary Examiner*—Peter Nerbun

*Attorney, Agent, or Firm*—Morton J. Rosenberg; David I. Klein

[57] ABSTRACT

A thread cutter for a chainstitch sewing machine includes a base plate, a cutter arm, a pincher, a cutter, a hook rod arm, a hook rod and a swing arm combined together. The hook rod arm is movably connected with the cutter arm and has its front end connected with the hook rod. The cutter arm has its front end firmly connected with a cutter on its upper surface and with the pincher on its lower surface and is also pivotally connected with the base plate. The swing arm is connected pivotally on the base plate and has its front head fitting in a notch of the rear end of the hook rod arm. A slide ring is fitted under a hole of the swing arm located in a guide slot of the cutter arm. The swing arm is moved by a driving means to swing to move the hook arm and the cutter arm forward and backward for cutting threads by a cutter fixed on the hook rod arm.

1 Claim, 5 Drawing Sheets

THREAD CUTTER FOR A CHAINSTICH SEWING MACHINE

BACKGROUND OF THE INVENTION

This invention concerns a thread cutter for chainstitch sewing machine, particularly one having a swing arm to move directly a hook rod arm and a cutter arm.

A known conventional thread cutter for a chainstitch sewing machine shown in FIG. 6, disclosed in a U.S. Pat. No. 4,098,209, includes a driving unit (not shown in the figure), a swing arm 10 moved by the driving unit to swing clockwise for a proper angle and then swing back to perform a round of thread cutting action. At the beginning of the action, a front head 101 of the swing arm 10 fits in notch 201 of a hook rod arm 20. As the swing arm 10 is moved to swing, the front head 101 moves down in the notch 210 so that the hook rod arm 20 is pushed down, guided by a screw 203 in a slot 202, moving down slantingly. During downward movement of the hook rod arm 20, it contacts a high point 301 of the cutter arm 3, forcing the cutter arm 30 also move along with the hook rod arm 20 slantingly. During continuous forward movement of the swing arm 10, the hook rod arm moves forward straight, guided by the slot 202 sliding along the screw 203, and then a hook rod 40 fixed with the hook rod arm 20 moves to let its front hook 401 and its rear hook 402 hook related threads, the hook rod arm then further moves forward, but the cutter arm 30 is to be stopped by means of the screw 303 blocking an upper end of the slot 302. So the cutter 50 fixed on the front end of the cutter arm 30 does not advance.

Next, the swing arm 10 is moved to swing back, retreating the hook rod arm 20, letting the hook rod 40 pass by the cutter 50 to cut the threads. Then the hook rod arm 20 is moved back to its original position, and the cutter arm 30 is moved back by a spring 304 lengthened, with the high point 301 not pushed by the hook rod arm 20. The thread cutter just described has the swing arm 10 directly moving the hook rod arm 20 forward and backward, and the cutter arm 30 is moved indirectly by means of the high point 301 being pushed by the hook rod arm forward and being retreated by the spring 304. Therefore, the cutter arm is indirectly moved back and forth by the swing arm, which gives rise to complicated structure of the conventional cutter, in addition to disorder, and wear and tear of connecting spots such as the high point 301 and the spring 304.

SUMMARY OF THE INVENTION

The object of this invention is to offer a thread cutter for a chainstitch sewing machine, having a swing arm directly moving a hook rod arm and a cutter arm to move forth and back in order to get rid of inconsistent movement of these components possibly caused by a long period of use.

The main feature of the present invention is a cutter arm having its rear end pivotally fixed on a base plate, a cutter fixed on a front end of the cutter arm, a pincher fixed under the front end of the cutter arm, a hook rod arm pivotally connected on the cutter arm and movable back and forth, a hook rod connected with the front end of the hook rod arm, the swing arm having a front head fitting in a notch in a rear end of the hook rod arm, a slide ring fixed under the swing arm being fitted in a guide slot of the cutter arm, and the swing arm being moved by a driving means to swing to let its front head move directly the hook rod arm and the cutter arm for cutting threads.

BRIEF DESCRIPTION OF DRAWINGS

The invention will be better understood by reference to the accompanying drawing, wherein.

DESCRIPTION OF THE PREFERRED EMBODIMENTS

Figure 1:
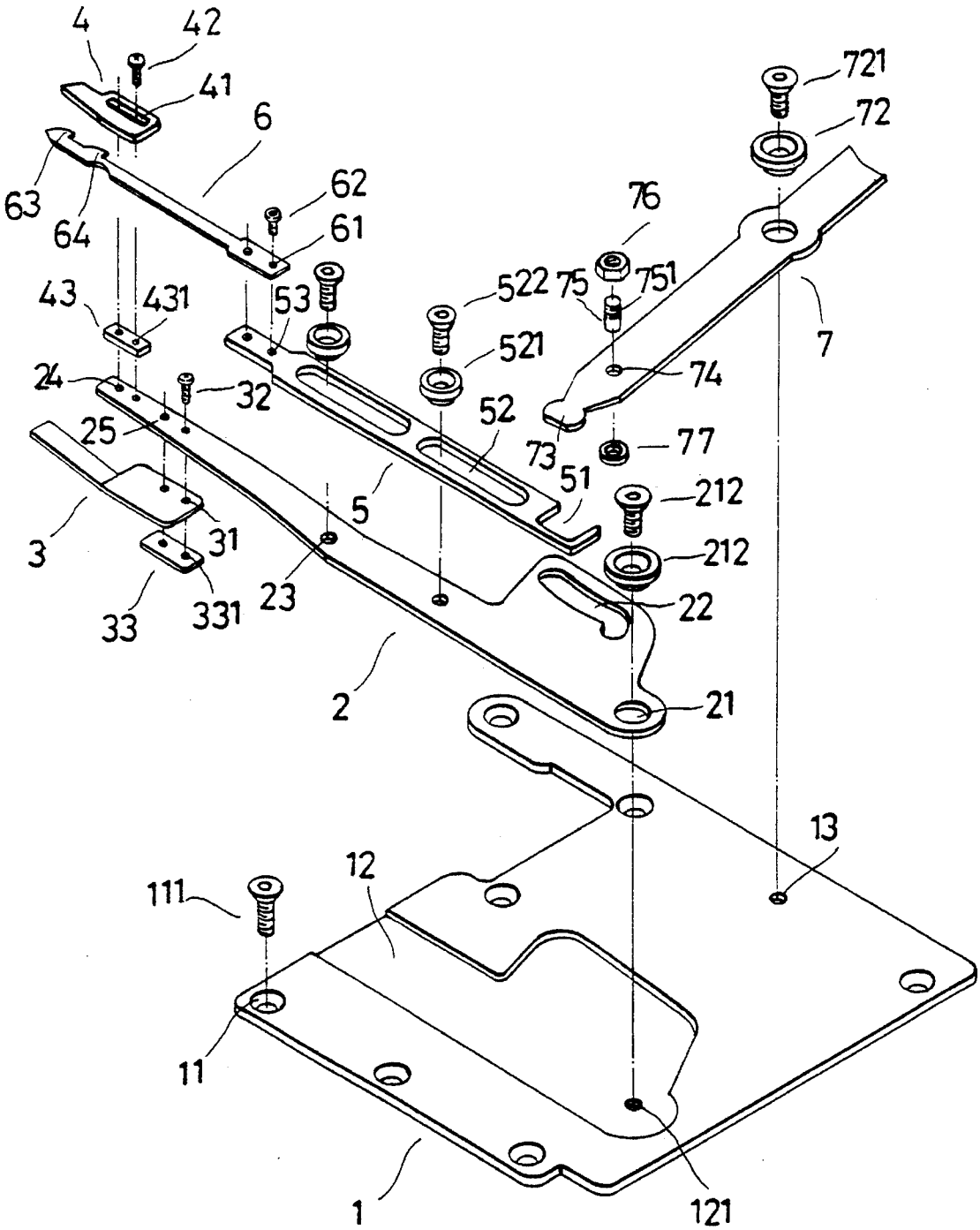
FIG. 1 is an exploded perspective view of a thread cutter for a chainstitch sewing machine in the present invention.
Figure 2:
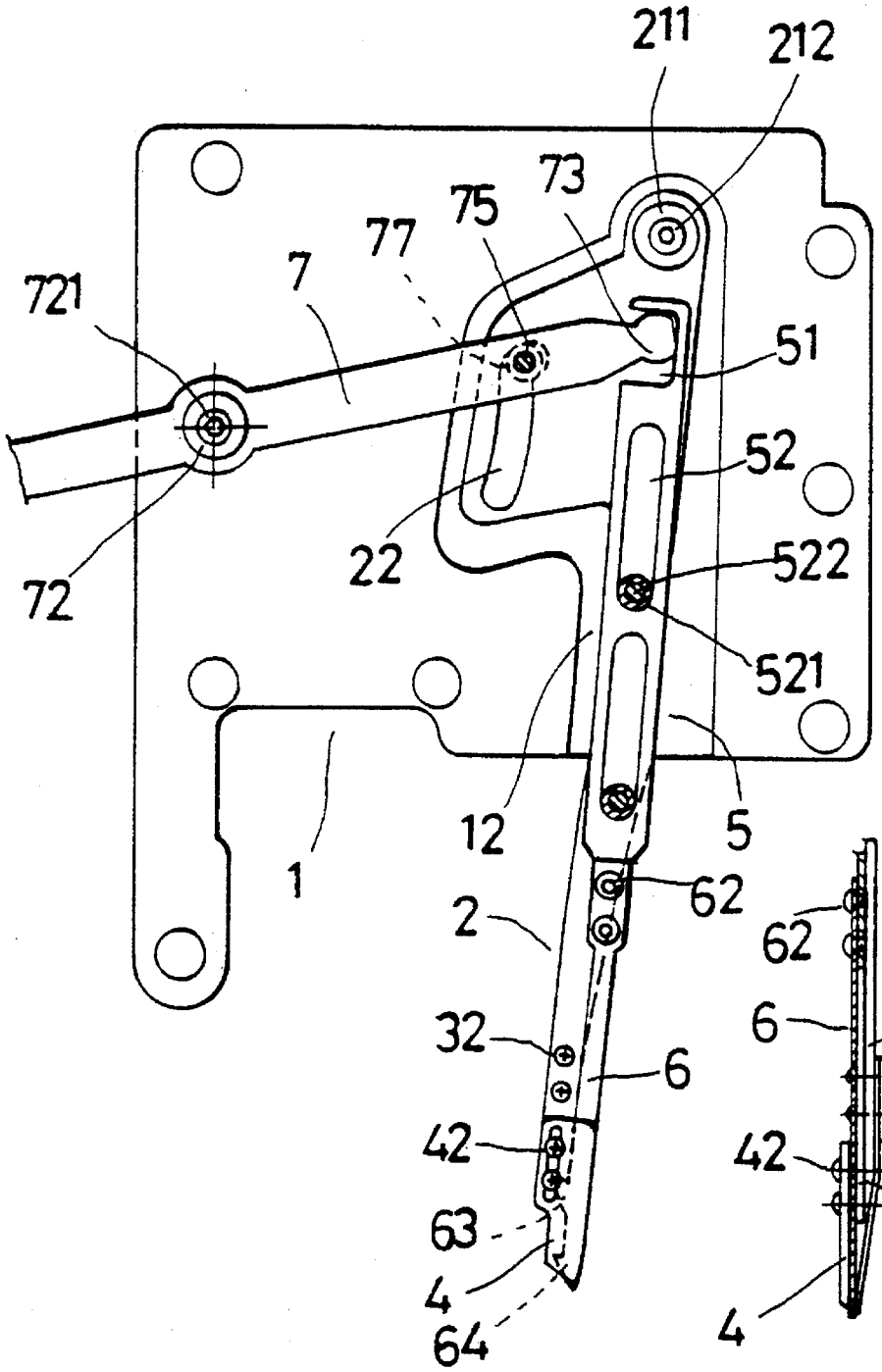
FIG. 2 is an upper view of the thread cutter for a chainstitch sewing machine in the present invention.
Figure 3:
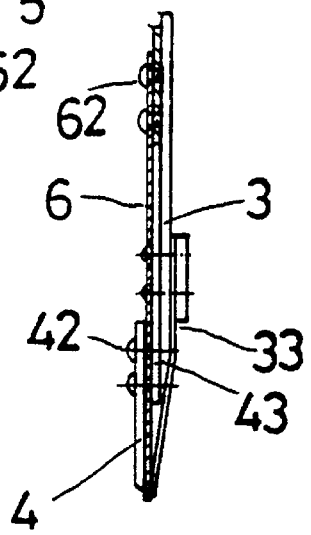
FIG. 3 is a partial cross-sectional view of the thread cutter for a chainstitch sewing machine in the present invention.

A thread cutter for a chainstitch sewing machine, as shown in FIGS. 1–3, includes a base plate 1, a cutter arm 2, a pincher 3, a cutter 4, a hook rod arm 5, a hook rod 6 and a swing arm as main components combined together.

The base plate 1 has a plurality of location holes 11 spaced apart in the peripheral edge for screws 111 to lock the base plate 1 on the table of a sewing machine, a recess 12 in an upper surface, a threaded hole 121 near an rear end of the recess 12, and another threaded hole 13 near an upper edge of the base plate 1.

The cutter arm 2 is elongated, having a hole 21 in a rear end for a screw 212 and a washer 211 to pass through and engage the threaded hole 121 of the base plate for securing the cutter rod 2 in its position, and a guide slot 22 having a slightly curved shape along one portion thereof, said portion having a larger width than that of the remaining portion of the slot. The remaining portion of the slot has a small bent section. The cutter arm further includes two threaded holes 23, 23 in an intermediate portion, two threaded holes 24, 24 and two holes 25, 25 behind the threaded holes 24, 24 in an front end portion.

The pincher 3 is shaped flat, having two holes 31, 31 in a rear end portion for screws 32, 32 to pass through the holes 25, 25 and 31, 31 to engage threaded holes 331, 331 of a locking member 33 so as to be fixed Under the front end of the cutter rod 2.

The cutter 4 has a slot 41 in a rear portion for a screw 42 to pass through and via a hole 431 of a cushion 43 to engage the threaded hole 24 of the cutter rod 2, being fixed on the front end the cutter rod 2.

The hook rod arm 5 is elongated, having a notch 51 in a rear end, two slots spaced apart in line in an intermediate portion for two screws 522, 522 and two washers 521, 521 respectively pass through to engage the threaded holes 23, 23, fixing the hook rod arm 5 on the cutter arm 2, and two threaded holes 53, 53 in a front end section.

The hook rod 6 is elongated, having a front hook 63 and a rear hook 64 spaced in line in a front end portion, and two holes 61, 61 in a rear end portion for screws 62, 62 to pass through to engage the threaded holes 53, 53 of the hook rod arm 5 so as to fix the hook rod 6 on the front end of the hook rod arm 5.

The swing arm 7 is shaped as a flat elongate plate, having a hole 71 in an intermediate portion for a screw 721 and a washer 72 to pass through to engage the threaded hole 13 of the base plate 1 so as to fix the swing arm 7 on the base plate 1, a front head 73 fitting in the notch 51 of the hook rod arm 5, a hole 74 behind the front head 73 for a screw 75 to pass through to fit in the guide slot 22 of the cutter arm 2, the screw 75 having a thread 751 in an upper portion to engage a nut 76 and a slide ring 77 fitting with its lower portion and in the guide slot 22 of the cutter arm 2. A driving means, not shown in the figures, is provided to be connected with a rear end of the swing arm 7 so that the swing arm 7 may be pushed by the driving means to swing with screw 721 as a fulcrum, forcing the front head 73 move for an angle needed for pushing down and up the hook rod arm 5 and related components for threads to be cut off.

Figure 4:
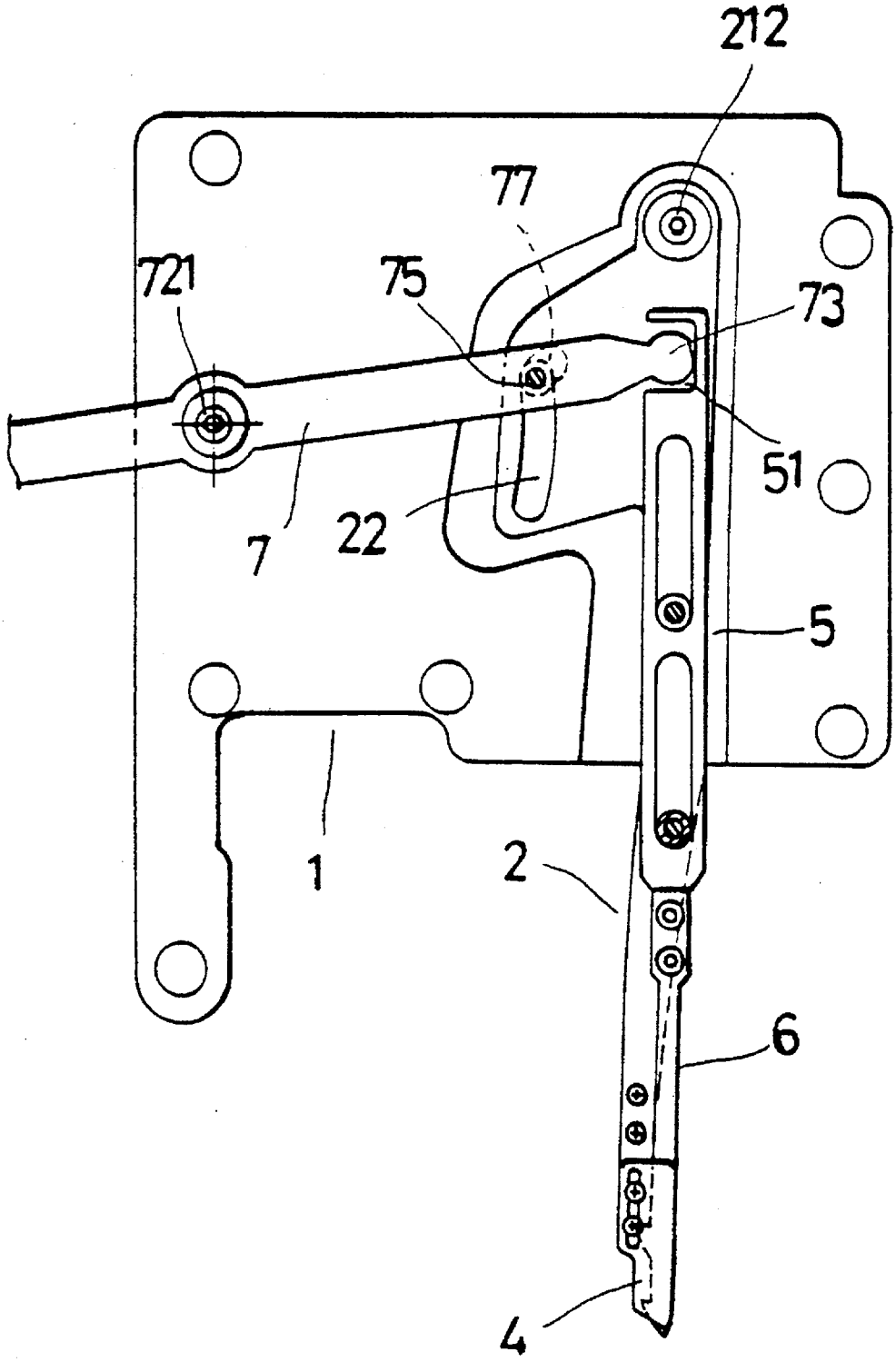
FIG. 4 is an upper view of a cutter and a hook rod of the thread cutter for a chainstitch sewing machine in the present invention, showing them being in moving condition.

In operating, referring to FIG. 4, the swing arm 7 is moved to swing by the driving means, permitting the slide ring 77 to move from its original position wherein the slide ring 77 is located in the bent end of the guide slot 22 of the cutter arm 2 to the front of the bent end in the beginning of movement of the swing arm 7. Then the cutter arm 2 is moved from its original tilting condition to an upright position by means of the screw 212 acting as a fulcrum. And simultaneously, the hook rod arm 5 is also moved vertical by the cutter arm 2.

Figure 5:
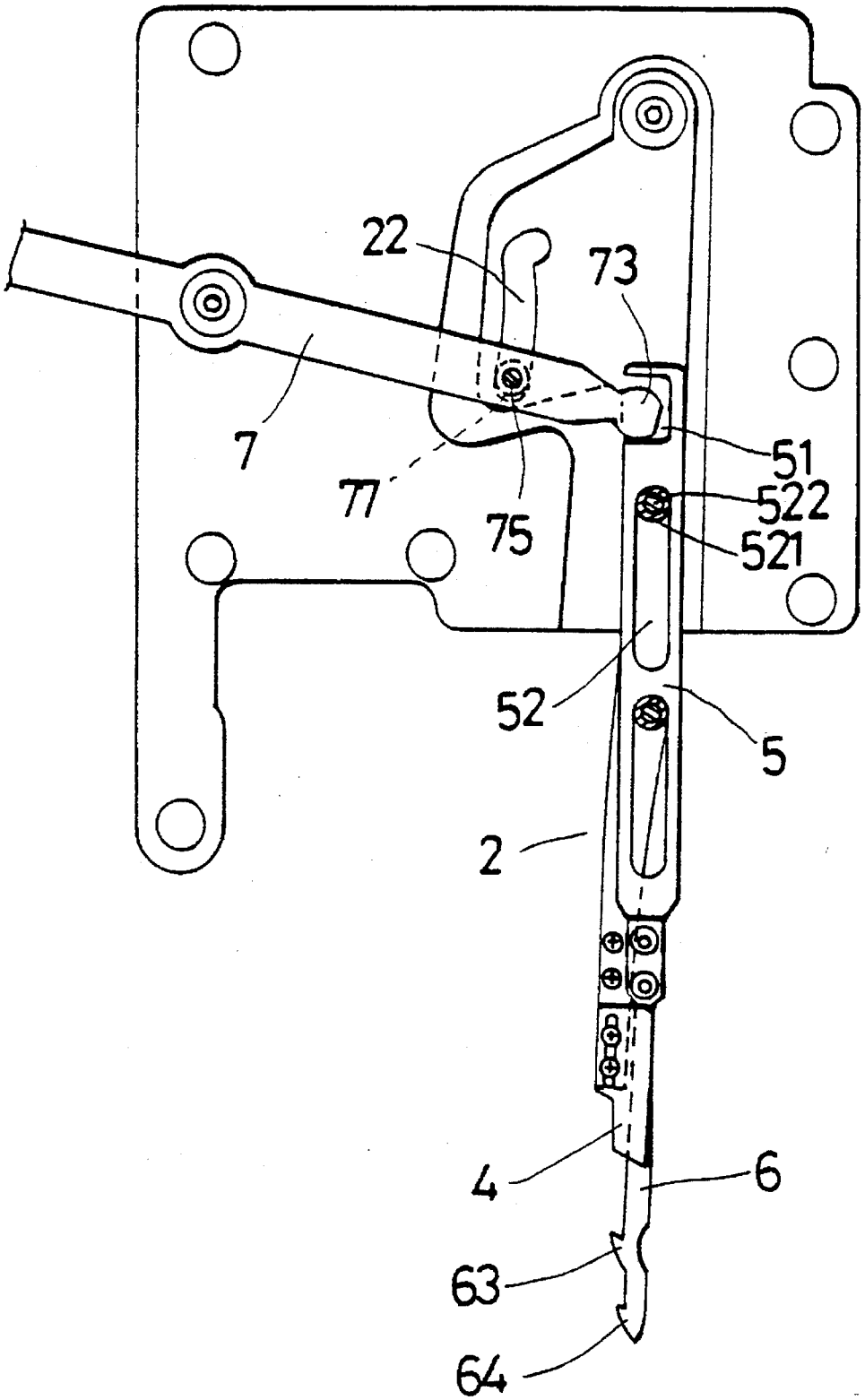
FIG. 5 is an upper view of the hook rod with related components of the thread cutter for a chainstitch sewing machine in the present invention, showing it being in advancing forward condition; and, FIG. 6 is an upper view of a known conventional thread cutter for a chainstitch sewing machine.
Figure 6:
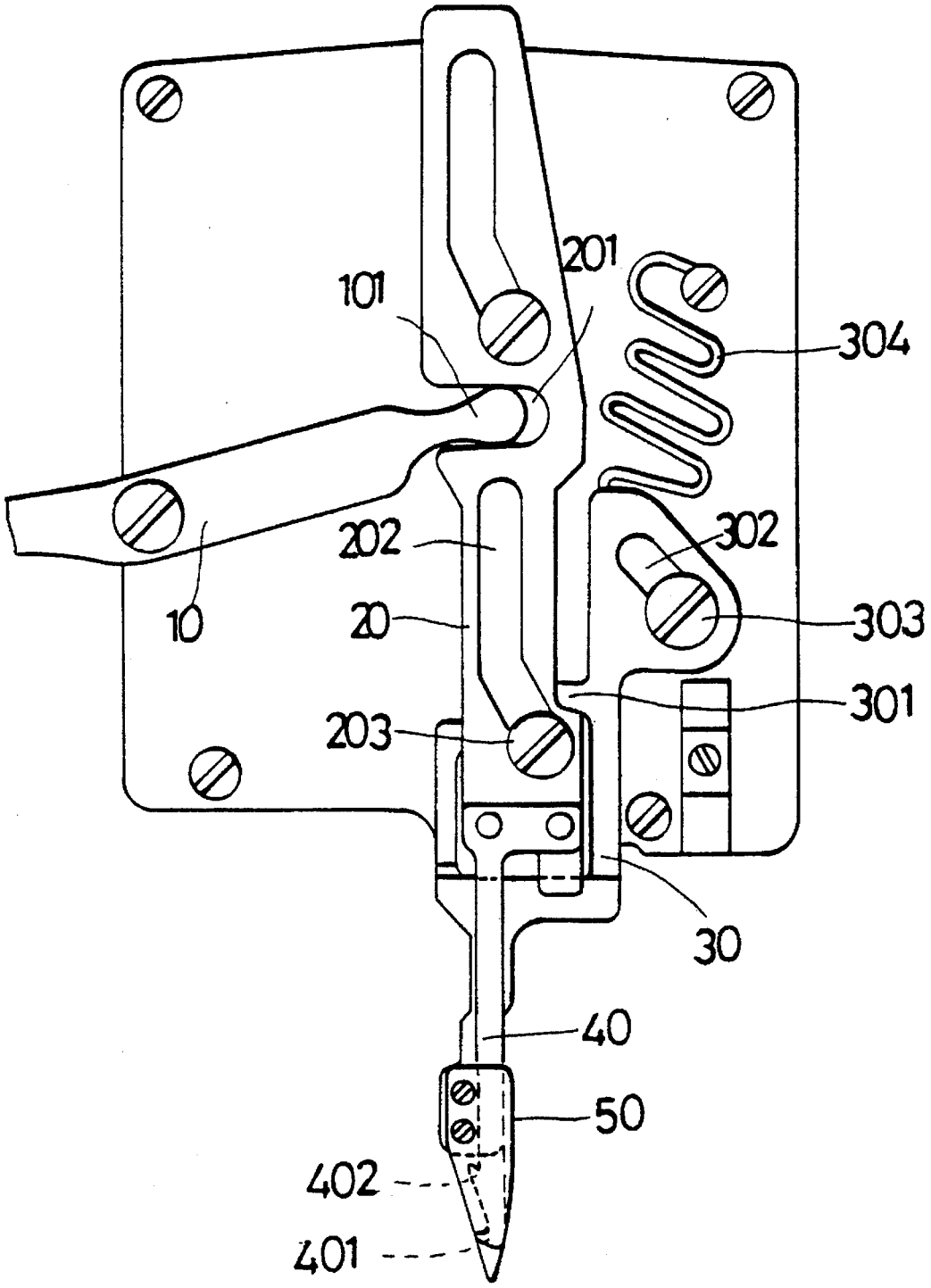
FIG. 6 (PRIOR ART)

Next, referring to FIG. 5, the swing arm 7 is continuously swung to change its angle to force the slide ring 77 to move to the front end of the guide slot 22, with the cutter arm 2 not moving at all. On the contrary, the hook rod arm 5 is moved to slide forward, pushed by the front head 73 in the notch 51, letting the the front end of the slot 52 contacting the screw 522 moved to separate from the screw 2 and then the rear end of the slot 52 contacting the screw 522 to be stopped there. Then the forward movement of the hook rod arm 5 also moves the hook rod 6 forward to hook the related threads with the front hook 63 and the rear hook 64.

Further more, the swing arm is swung to retreat back, pulling the hook rod arm 5 and the hook rod 6 back to their original position. During retreating movement of the hook rod 6, the front and the rear hook 63 and 64 thereof pass by the blade of the cutter 4 in close contact with the cutter 4 so that the cutter 4 will cut off the threads hooked by the hooks 63 and 64. Finally, in the course of time, the swing arm 7 returns back to its original position, with the cutter arm 2 and the hook rod arm 5 also recovering their slanting position, finishing one round of thread cutting action.

As can be understood from the above description, the swing arm in the present invention directly moves the hook rod arm and the cutter arm, improving indirect movement of the swing arm to move the cutter arm in the known conventional thread cutter for a chainstitch sewing machine.

While the preferred embodiments of the invention have been described above, it will be recognized and understood that various modifications may be made therein and the appended claims are intended to cover all such modifications which may fall within the spirit and scope of the invention.

What is claimed is:

1. A thread cutter for a chainstitch sewing machine comprising:

a base plate nearly shaped square, having a plurality of location holes spaced apart in a peripheral edge for screws to lock said base plate on a table of a sewing machine, and a threaded hole in one side;

a cutter arm shaped elongate, having two threaded holes and two holes behind said threaded holes spaced in a front portion;

a pincher being flat and having two-holes in a rear portion for screws to pass through and also through said holes of said cutter arm to engage a threaded hole of a locking member, said pincher thus being fixed on a front end of said cutter arm;

a hook rod arm having two threaded holes in a front portion;

a hook rod shaped elongate end having two holes in a rear end for a screw to pass through to engage said threaded hole of said hook rod arm and to fix said hook rod on said front end of said rod arm, and a front hook and a rear hook behind said front hook in a front end portion of said hook rod;

a swing arm shaped elongate and having a hole in an intermediate portion for a screw and a washer to pass through to engage said threaded hole of said base plate so as to fix said swing arm thereon, a rear end connected with a driving means so that said swing arm can be moved by said driving means to swing with said screw as a fulcrum, moving a front head through an angle; and characterized by:

said base plate having a recess in its upper surface, for said cutter arm to lie therein, a threaded hole in a rear portion of said recess for a screw to engage so as to pivotally fix said cutter arm;

said cutter arm having a hole for a screw and a washer to pass through to engage said threaded hole of said base plate, a guide slot having a slightly curved shape section and a bent rear end section, and two holes in an intermediate portion;

said hook rod arm having a notch in a rear end, two slots provided in line in an intermediate portion, a screw and a washer provided respectively to pass through and engage said threaded hole of said cutter arm so as to fix said hook rod arm on said cutter arm; and, said swing arm having its front head fitting in said notch of said hook rod arm, a hole behind said front head for a screw to pass through and also through said guide slot of said cutter arm, said screw having a male thread in an upper portion to engage a nut and fitting in a slide ring at its bottom end.

* * * * *